United States Patent [19]

Kamm

[11] 4,055,120

[45] Oct. 25, 1977

[54] APPARATUS FOR ADJUSTING A TENSIONING DEVICE IN PLATE CYLINDERS OF ROTARY PRINTING MACHINES

[75] Inventor: Wolfgang Kamm, Stettlen, Switzerland

[73] Assignee: Maschinenfabrik Wifag, Bern, Switzerland

[21] Appl. No.: 674,587

[22] Filed: Apr. 7, 1976

[30] Foreign Application Priority Data

Apr. 14, 1975 Sweden ..... 7504270

[51] Int. Cl.[2] ..... B41B 1/00; B41F 27/00

[52] U.S. Cl. ..... 101/378; 33/184.5; 101/415.1; 101/DIG. 12

[58] Field of Search ..... 101/216, 219, 248, 415.1, 101/378, DIG. 12, 426; 33/184.5, 181 R, 185 R

[56] References Cited

U.S. PATENT DOCUMENTS

| | | | |
|---|---|---|---|
| 1,377,511 | 5/1921 | Novotny | 33/184.5 |
| 2,321,228 | 6/1943 | McMullen | 33/184.5 |
| 2,559,533 | 7/1951 | Daniels | 101/DIG. 12 |
| 2,633,076 | 3/1953 | Rineer | 101/DIG. 12 |
| 2,688,803 | 9/1954 | Huck | 33/184.5 |
| 2,994,964 | 8/1961 | Moffet | 101/DIG. 12 |
| 3,154,012 | 10/1964 | Fischer | 101/DIG. 12 |
| 3,613,252 | 10/1971 | Moos | 101/DIG. 12 |
| 3,664,030 | 6/1969 | Pope, Jr. | 33/184.5 |
| 3,851,583 | 12/1974 | Norton | 101/415.1 |
| 3,943,851 | 3/1976 | Inada et al. | 101/DIG. 12 |

FOREIGN PATENT DOCUMENTS

| | | | |
|---|---|---|---|
| 469,354 | 11/1927 | Germany | 33/184.5 |

*Primary Examiner*—Louis G. Mancene
*Assistant Examiner*—Paul J. Hirsch
*Attorney, Agent, or Firm*—Ostrolenk, Faber Gerb & Soffen

[57] ABSTRACT

In a rotary printing machine, the cylinder for holding the printing plate has a printing plate tensioning device formed in it, which includes an adjustably positionable tensioning rail. To adjust this rail, a set of marks is formed on the cylinder. A support base carries an optical device to view the marks. On the base there are tensioning rail engaging adjustably positionable abutments and the alignment of the marks in the field of view of the optical device enables proper positioning of the abutments and of the tensioning rail.

8 Claims, 2 Drawing Figures

APPARATUS FOR ADJUSTING A TENSIONING DEVICE IN PLATE CYLINDERS OF ROTARY PRINTING MACHINES

BACKGROUND OF THE INVENTION

The invention relates to rotary printing machines in general, to one or more printing plates thereof and more particularly to a method of and apparatus for adjusting the leading, tensioning rail of tensioning devices in the printing plate support cylinder of a rotary printing machine.

In rotary printing machines, thin, flexible printing plates are used. Usually, one or more plates are mounted under tension on a plate support cylinder. The ends of each of the printing plates are bent away in an accurately registering manner and the ends are inserted into tensioning devices formed in the plate cylinder. Tensioning rails are formed as part of the tensioning device. These rails have a generally beak shaped portion, and the printing plate ends are secured over these beak-like portions. There are a leading tensioning device and its tensioning rail at the leading or forward end of the printing plate (as the cylinder rotates) and a trailing tensioning device and trailing tensioning rail at the trailing end of the printing plate. The tensioning of the plate is usually effected by means of the trailing tensioning rail. The leading tensioning rail determines the position of the printing plate on the printing cylinder. The leading rail must be adjusted in a perfectly registering manner, particularly in multiple color printing.

The adjustment in an accurately registering manner of the leading tensioning rail may be disturbed by initial manufacturing tolerances and by division faults that become noticeable in the tensioning device, as well as in the receiving grooves for the tensioning device in the plate cylinders.

SUMMARY OF THE INVENTION

It is an object of the invention to provide a method for adjusting the position of the tensioning rail of a tensioning device of a printing plate cylinder from the desired position.

It is another object of the invention to provide an apparatus for performing that purpose.

It is a further object of the invention to accomplish the foregoing objects using an optical adjusting technique.

The present invention concerns a method of and an apparatus for adjusting in an accurately registering manner the leading tensioning rail of a tensioning device in the plate cylinder of a rotary printing machine. According to the invention, at least two control marks (although one could be used) for the tensioning device are formed on the cylinder, preferably by being accurately machined into the surface of the cylinder. Any arrangement of these marks is acceptable, but it is preferable that they be arrayed parallel to the axis of and on the surface of the plate cylinder and at a predetermined control spacing and spaced at a predetermined angle around the cylinder from the receiving grooves for the tensioning devices. Using these marks as a guide, the base position of the tensioning rail can be optically determined and then accurately adjusted for printing purposes.

The present invention also concerns an apparatus for adjusting the leading tensioning rail of a tensioning device in the plate cylinder of a rotary printing machine. Such apparatus includes a base member. It includes at least one optical control device mounted on the base member, with one such device being provided for each control mark on the cuylinder. A plurality of guides are formed in the base member. A plurality of abutment members are diplaceable with respect to and received in the respective guides so as to be adjustable with respect to the base member to previously calculated positions. The abutment members are provided for engaging the tensioning rail that is to be adjusted. A plurality of base member supports are provided on the base member for engaging the plate cylinder at locations that are angularly spaced around the cylinder from the tensioning device. The supports are arranged so that each optical control device is itself oriented substantially radially but more particularly such that its field of view is oriented substantially radially to the plate cylinder when the apparatus is in use with the abutment members abutting against the front or leading edge of the leading tensioning rail. The tensioning rail is adjusted in position until the field of view off each optical device takes in its control mark.

BRIEF DESCRIPTION OF THE DRAWINGS

A preferred embodiment of the invention will be described with reference to the accompanying drawings, in which.

DESCRIPTION OF A PREFERRED EMBODIMENT

Figure 1:
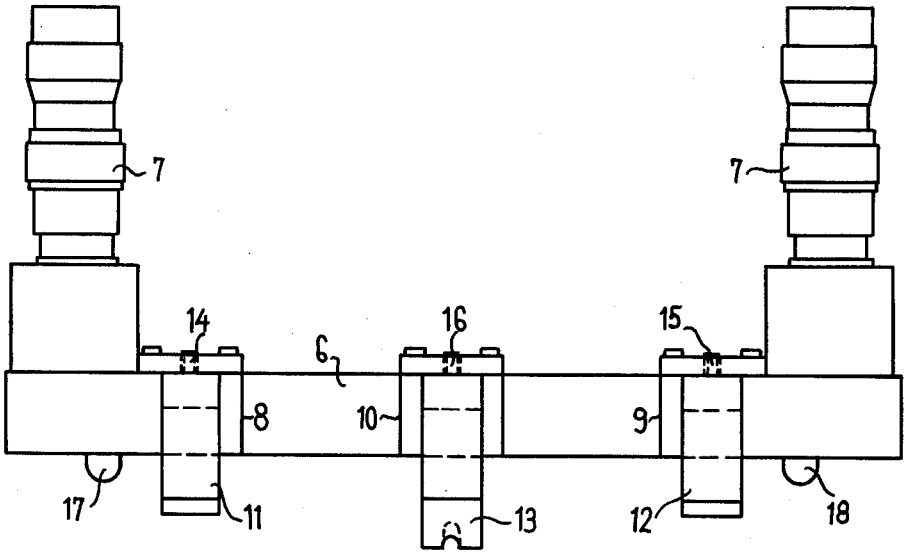
FIG. 1 is an end elevational view of an apparatus according to the invention for performing the method according to the invention.

Referring to the drawings, a conventional cylindrically shaped printing plate support cylinder 4 is shown. It includes a conventional tensioning device 2, which is mounted in a receiving groove 3 of the plate cylinder 4. The tensioning device includes a conventional break-line tensioning rail 1.

Figure 2:
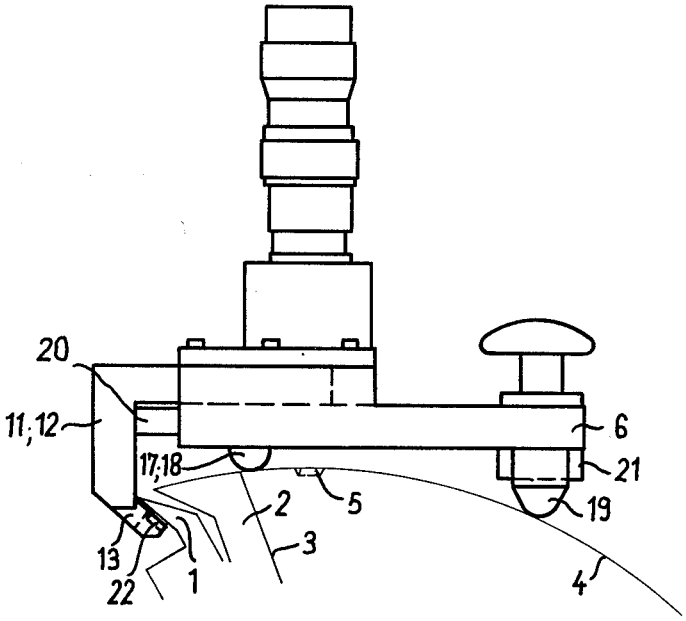
FIG. 2 is a side view of the apparatus of FIG. 1 in position on a plate cylinder having a tensioning device.

Control marks 5, e.g. control circles, are machined with extreme accuracy into the surface of the plate cylinder 4 to serve as a base for measurement. Although any number of control marks 5 may be used, two control marks 5 are preferable for each tensioning device 2 and for each direction of rotation of the control cylinder 4, i.e. some cylinders are intended to rotate clockwise or counterclockwise in FIG. 2 for different printing operations. These marks 5 are in previously calculated positions relative to each other and are preferably arranged axially along the plate cylinder.

There are two optical control devices 7, or a number of such devices corresponding to the number of marks 5, provided for a particular tensioning rail adjustment. Devices 7 are disposed on top of a base plate 6 and they are spaced apart a distance corresponding to the distance axially of the cylinder 4 between the control marks 5.

At the side of the base plate 6, there are provided guides 8, 9 and 10 into which are inserted abutments 11 and 12 and a forked abutment 13, respectively. The abutments are fixable at desired positions, moving sideways with respect to the base plate 6 and transverse to the fields of view of the optical control devices, in their guides to be at predetermined distances from optical control devices 7, by means of adjusting screws 14, 15 and 16. The abutments 11 and 12 are adjusted and fixed, left and right in FIG. 2, by means of limit members 20 to a previously calculated measure which is related to any individual plate cylinder 4.

Two fixed supports 17 and 18 near groove 3 and an adjustable support 19 remote from groove 3 and all connected beneath base plate 6 are provided for supporting the entire apparatus on the surface of plate cylinder 4. The adjustable support 19 is correctly positioned on cylinder 4 by means of a spacer member 21. The thickness of spacer member 21 depends upon the diameter of the plate cylinder 4. Spacer member 21 is selected so that in use, each optical control device 7 is oriented to extend exactly radially to the plate cylinder 4 and, more important, to take in a field off view radially to that cylinder.

Then the apparatus is seated on the plate cylinder 4 with the abutments 11 and 12 resting against the front or leading side (or the side away from devices 7) of the tensioning rail 1 and with the forked abutment 13 embracing a bolt 22 that serves to center the printing plate.

The position of the tensioning rail 1 is changed, by means of a previously known, conventional adjusting device (not shown) built into each tensioning device 2, until the centers of the optical control devices 7 coincide exactly with the control marks 5. With the adjustments completed, the entire apparatus is then removed.

When the leading tensioning rails 1 are adjusted in the foregoing manner, using the above described apparatus, the printing plates (not shown), when bent over the tensioning rails in an accurately registering manner, are located under tension on the plate cylinder 4 in their correct printing positions. At any later time, a control check of the position of the leading tensioning rail, which may be necessary under certain circumstances, can be effected with the apparatus according to the invention within a very short time.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. Apparatus for adjusting a tensioning rail of a tensioning device in a printing plate support cylinder of a rotary printing machine, comprising:

a support base member;

at least one abutment member engageable with the tensioning rail; said abutment member being supported by said base member and being adjustable in position with respect to said base member;

an optical control device supported on said base member, oriented so as to view a field of view on the plate cylinder and spaced away from said abutment member a distance measured angularly around the plate cylinder; adjustable support means on said base member and engageable with the plate cylinder for adjusting the tilt and orientation of said base member on and with respect to the plate cylinder, thereby to orient said optical control device to have its field of view radially aligned with the plate cylinder;

said base member having a bottom, a top and sides; said abutment member projecting from a said side of said base member and is movable with respect to that said side; said optical control device being above said top of said base member; said support means extending beneath said bottom of said base member.

2. The apparatus for adjusting a tensioning rail of claim 1, wherein there are a plurality of said abutment members aligned in a respective line and a plurality of said optical control devices.

3. The apparatus for adjusting a tensioning rail of claim 2, wherein said optical control devices are aligned in a respective line; said line of said abutment members and said line of said optical control devices being both parallel to the axis of the plate cylinder and being parallel to each other.

4. The apparatus for adjusting a tensioning rail of claim 2, wherein said abutment members projecting from said sides of said base member such that all said abutment members extend in the same direction; said abutment members being movable with respect to the said sides of said base member from which they project; said optical control devices being all positioned above said top of said base member.

5. The apparatus for adjusting a tensioning rail of claim 4, wherein said adjustable support means comprise a plurality of spaced apart support elements; for at least one of said support elements, it is adjustable in its distance from said bottom of said base member.

6. The apparatus for adjusting a tensioning rail of claim 5, wherein said adjustable support element comprises means for seating against the plate cylinder and comprises a replaceable, varying thickness spacer located between that said means and said base member.

7. The apparatus for adjusting a tensioning rail of claim 4, wherein each said abutment member is fixable in position with respect to said base member; means for so fixing each said abutment member; a respective limit member on said base member for adjusting the position of each said abutment member.

8. The apparatus for adjusting a tensioning rail of claim 7, wherein one said abutment member has a forked edge for embracing a bolt that serves to center a printing plate on the plate cylinder.

* * * * *